United States Patent [19]

Hoppmann et al.

[11] Patent Number: 4,844,699

[45] Date of Patent: Jul. 4, 1989

[54] SUBMERSIBLE PUMP

[75] Inventors: Peter G. Hoppmann, Waterford; Werner Schmitt, Falls Church, both of Va.

[73] Assignee: Hoppmann Corporation, Chantilly, Va.

[21] Appl. No.: 597,661

[22] Filed: Apr. 6, 1984

[51] Int. Cl.[4] ..... F04C 1/18

[52] U.S. Cl. ..... 417/134

[58] Field of Search ..... 417/118, 126, 134

[56] References Cited

U.S. PATENT DOCUMENTS

| | | | |
|---|---|---|---|
| 350,761 | 10/1886 | Neff | 417/118 |
| 570,884 | 11/1896 | Donato | 417/134 |
| 1,323,864 | 12/1919 | Human | 417/128 |
| 3,898,018 | 8/1975 | Weis | 417/118 |

FOREIGN PATENT DOCUMENTS

| | | | |
|---|---|---|---|
| 541953 | 12/1941 | United Kingdom | 417/118 |

*Primary Examiner*—Leonard E. Smith

*Attorney, Agent, or Firm*—Birch, Stewart, Kolasch & Birch

[57] ABSTRACT

A pneumatically operated submersible pump and method for operating the same including a housing having a chamber disposed therein. A first opening is positioned in the housing for permitting liquid to flow into the chamber. A seal is operatively disposed within the camber for selectively sealing the first opening. A source of compressed air is provided for supplying compressed air to the chamber. A discharge opening is positioned in the housing for withdrawing liquid from the chamber. A predetermined quantity of liquid initially flows into the chamber through the first opening for imparting movement to the seal means for subsequently sealing the first opening. Thereafter compressed air is supplied to the chamber which displaces the liquid through the discharge opening thereby releasing the seal for repeating a pumping operation by again permitting the predetermined quantity of liquid to flow into the chamber through the first opening.

2 Claims, 2 Drawing Sheets

SUBMERSIBLE PUMP

BACKGROUND OF THE INVENTION

1. Field of the Invention

The present invention relates to a pneumatically operated submersible pump for selectively pumping a fluid therefrom.

2. Description of Background Art

Hithertofore, electrically operated pumps have been utilized to pump a solution through a trough which is utilized to grow a hydroponic plant. The electric pumps are normally submersible pumps which must be connected to a timer so as to periodically pump a predetermined quantity of solution through the trough in the hydroponic growing system. However, the electric submersible pump emits heat to the nutrient solution. Raising the temperature of the nutrient solution sometimes may have a harmful effect on the root system of a hydroponic plant. In addition, there is a potential of an oil leak from the submersible electric pump into the liquid nutrient.

SUMMARY AND OBJECTS OF THE INVENTION

The present invention provides a pneumatically operated submersible pump which periodically discharges a predetermined quantity of liquid therefrom.

Another object of the present invention is to provide a pneumatic pump which is continuously supplied with compressed air for discharging a quantity of liquid from a pump housing. A seal is provided in the pump housing for selectively closing an opening therein. When the opening in the housing is closed, compressed air displaces liquid from within the housing to provide a pumping operation. After a predetermined quantity of liquid is pumped from the housing, the seal opens the opening therein to permit liquid to flow into said housing while compressed air bubbles outwardly through the opening. Subsequently, the seal is again imparted with movement to close the opening thereby permitting the compressed air to again discharge a predetermined quantity of liquid therefrom.

A further object of the present invention is to provide a pneumatically operated submersible pump which does not produce any heat.

A further object of the present invention is to provide a pneumatically operated submersible pump which does not include any foreign liquid of materials therein which may have a tendency to contaminate the fluid in which the submersible pump is positioned.

A further object of the present invention is to provide a submersible pump which may be utilized together with a hydroponic growing system wherein the compressed air which periodically bubbles through an opening in the pump housing while liquid is supplied thereto tends to provide oxygen to the liquid nutrient solution, thereby producing a beneficial result.

These and other objects of the present invention are accomplished by providing a housing including a chamber disposed therein. A first opening is provided in the housing. A supply of compressed air is operatively connected to the housing for supplying compressed air to the chamber. A seal is operatively mounted within the chamber for selectively opening or closing the opening in the housing. A discharge opening is provided for selectively discharging a predetermined quantity of liquid from the housing. Initially, liquid enters into the chamber through the opening in the housing. After a predetermined quantity of liquid is supplied to the chamber, the seal closes the opening therein. Supplying compressed air to the chamber displaces the liquid within the chamber to discharge a predetermined quantity through the discharge opening. Thereafter, the seal is displaced away from the opening, thereby again permitting a predetermined quantity of liquid to enter into the chamber in the housing. Thereafter, the cycle is repeated and compressed air sequentially displaces the liquid to discharge a predetermined quantity from the chamber.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
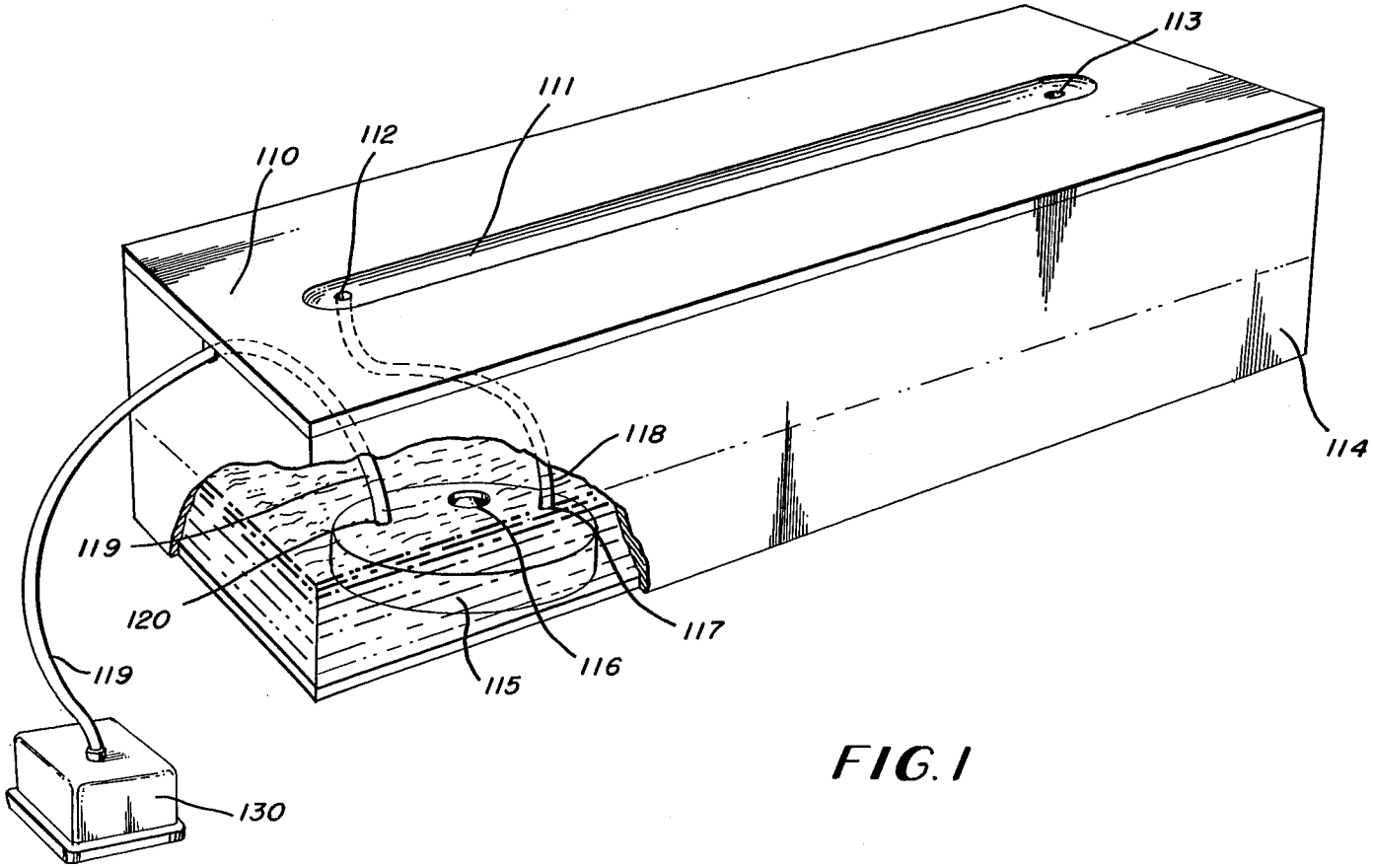
FIG. 1 is a partially cutaway perspective view showing the submersible pump of the present invention in combination with a source of compressed air in a hydroponic growing trough.
Figure 2:
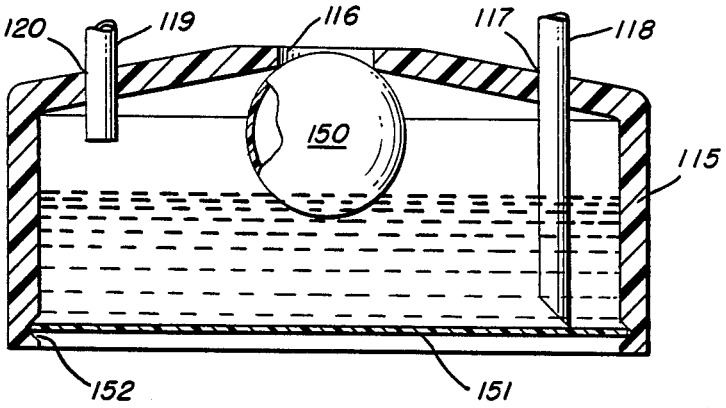
FIG. 2 is a sectional view illustrating a first example of the submersible pump according to the present invention.

As illustrated in FIGS. 1 and 2, a submersible pump includes a housing 115 having a first opening 116 disposed in an upper surface thereof. The upper surface of the housing is sloped and the opening 116 is formed in the apex of the sloped upper wall. The housing 115 includes sidewalls projecting downwardly therefrom. A lower surface 151 is removably positioned in a groove 152 to define a chamber within the housing 115.

A compressed air supply means 130 is operatively connected to a conduit 119 connected through a second opening 120 in the housing 115. A discharge conduit 118 is operatively positioned with a discharge opening 117 in the housing 115. A seal means 150 is operatively positioned within the chamber 115 for selectively closing and opening the opening 116 formed in the apex of the sloped upper wall.

As illustrated in FIG. 1, the housing 115 is submerged within a liquid contained in a tank 114. The tank 114 includes a lid 110 disposed on the upper surface thereof. A trough 111 is molded into the upper surface of the top 110. The discharge conduit 118 is operatively connected to the trough 111 through an opening 112. Liquid disposed within the tank 114 is periodically pumped through the discharge conduit 118 and the opening 112 along the trough 111. Thereafter, the liquid is returned to the tank 114 through an opening 113.

As illustrated in FIG. 2, the seal means 150 is a buoyant spherical ball which floats on the liquid within the chamber formed in the housing 115. When a predetermined quantity of liquid is disposed within the chamber, the seal means 150 closes the opening 116 formed in the apex of the sloped upper wall. Because the upper wall of the housing 115 is sloped, the buoyant spherical ball 150 centers itself to ensure a tight seal around the opening 116 in the apex of the sloped upper wall.

Figure 3:
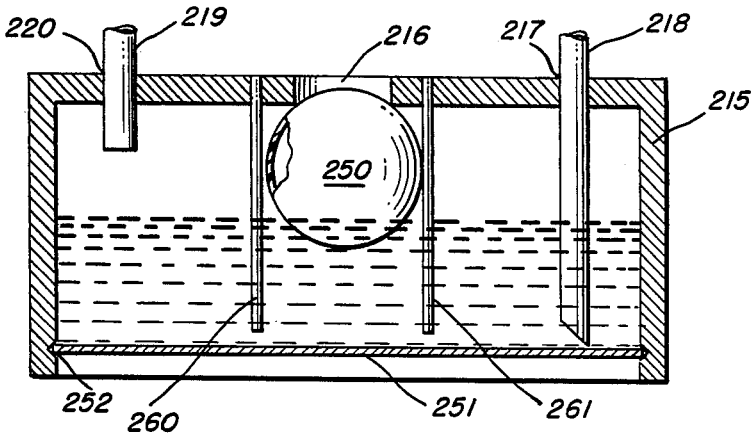
FIG. 3 is a sectional view illustrating a second embodiment of a submersible pump according to the present invention.
Figure 4:
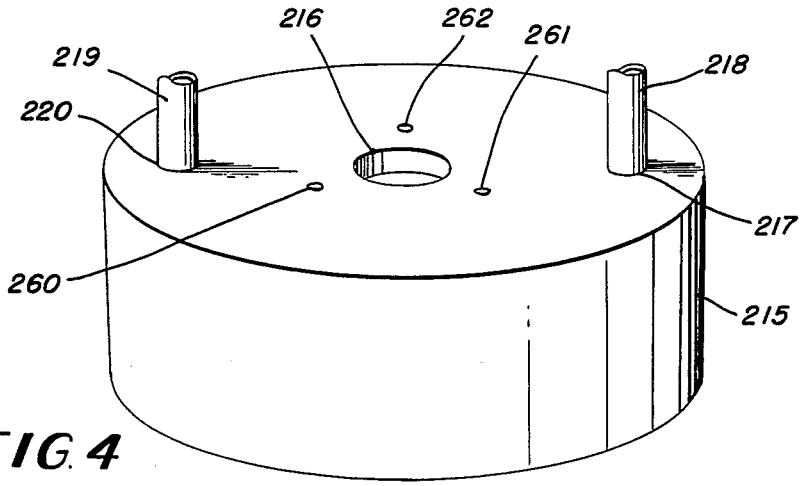
FIG. 4 is a perspective view illustrating the outer housing of the second embodiment of the submersible pump.

A second embodiment of the present invention is illustrated in FIGS. 3 and 4. In this embodiment the housing 215 includes a substantially flat upper wall and sidewalls which are substantially orthogonally disposed relative thereto. The housing 215 is substantially similar in shape comparable to the circular shape of the housing 115. A lower surface 251 is operatively connected to the sidewalls of the housing 215 by snap-fitting within the groove 252. The lower surface 251 is removably mounted, similarly to the lower surface 151, for periodically cleaning the interior chamber of the housing 215, 115, respectively.

The second embodiment of the present invention includes a substantially flat upper surface. A buoyant spherical ball 250 is operatively disposed within the chamber in the housing 215 to periodically close the opening 216 in the upper surface thereof. Due to the fact that the upper surface of the housing is substantially flat, guide pins 260, 261 and 262 are positioned to guide the movement of the spherical ball 250. A compressed air supply means is operatively connected to the chamber in the housing 215 by means of a conduit 219. The conduit 219 projects through an opening 220 in an upper surface of the housing. A discharge conduit 218 is operatively disposed through a discharge opening 217 in the upper surface of the housing 215.

In operation, the submersible pump is positioned within the liquid contained in the tank 114. Liquid enters through the opening 116, 216 in the upper surface of the housing. After a predetermined quantity of liquid flows into the chamber within the housing 115, 215, the buoyant spherical ball 150, 250 floats upwardly to seal the opening 116, 216. Compressed air supplied through the conduit 119, 219 pressurizes the contents of the chamber in the housing 115, 215. When a predetermined pressure is achieved within the housing 115, 215, a predetermined quantity of liquid is discharged through the conduit 118, 218. Upon lowering the liquid level within the chamber, the buoyant spherical ball 150, 250 is lowered to open the opening 116, 216 in the upper surface of the housing 115, 215. Thereafter, again a predetermined quantity of liquid flows into the chamber in the housing 115, 215. Sequentially, the buoyant spherical ball 150, 250 will float upwardly to close the opening 116, 216 after the predetermined quantity of liquid flows into the chamber within the housing 115, 215. Again, the compressed air supplied to the housing pressurizes the liquid contained therein to discharge a predetermined quantity liquid through the discharge conduit 118, 218.

The compressed air supplied through the conduit 119, 219 is continuously supplied thereto. Thus, when the buoyant spherical ball 150, 250 is in the lower opened position, compressed air bubbles upwardly through the opening 116, 216 to provide oxygen to the liquid contained within the tank 114. After the predetermined quantity of liquid flows into the chamber formed in the housing 115, 215, the buoyant spherical ball 150, 250 floats upwardly to close the opening 116, 216. At that point, the compressed air supplied through the conduit 119, 219 pressurizes the interior of the chamber in the housing 115, 215 to thereafter displace a predetermined quantity of liquid through the discharge conduit 118, 218.

Although not illustrated in FIG. 1, the compressed air supply means 130 may be electrically operated to continuously supply a quantity of compressed air to the chamber formed in the housing 115, 215. In this manner only air is supplied to the submersible pump positioned within the liquid in the tank 114. Thus, no heat is given off by the operation of the submersible pump. Further, no foreign liquid or materials are positioned within the housing 115, 215 which may have a tendency to contaminate the liquid disposed within the tank 114.

The present invention permits the air pump to run continuously due to the automatic displacement container formed by the housing 115, 215. Without relying on an automatic recycling action, the present invention periodically pumps a predetermined quantity of liquid from the chamber formed in the housing 115, 215. During a refilling of the chamber when the buoyant spherical ball 150, 250 is displaced away from the opening 116, 216, compressed air bubbles upwardly through the liquid to provide oxygen thereto. The present invention periodically cycles to discharge liquid from the chamber in the housing 115, 215 and sequentially supply liquid to the chamber so that no back pressure is created. A timer mechanism is not necessary to be utilized together with the present invention. Compressed air may be continuously supplied to the housing 115, 215 and is automatically vented or utilized in order to displace liquid from the chamber contained within the housing 115, 215.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A pneumatically operated submersible pump for automatically intermittently pumping a fluid comprising:

a housing including an upper surface, sidewalls and a lower surface defining a chamber disposed therein;

a first opening in said upper surface of said housing for permitting a predetermined quantity of liquid to flow into said chamber;

compressed air supply means for continuously supplying compressed air to said chamber, said compressed air initially being vented to escape through said first opening and subsequently pressurizing said chamber after said predetermined quantity of liquid enters said chamber; and a float seal operatively disposed within said chamber for automatically selectively sealing said first opening after said predetermined quantity of liquid enters said chamber and for simultaneously preventing the escape of compressed air, said upper surface of said housing being sloped and said first opening being centrally disposed through the apex of said sloped upper surface for guiding the movement of the float seal, said float seal is a buoyant spherical ball for selectively opening and closing said first opening;

a discharge opening in said housing for withdrawing liquid from said chamber;

said predetermined quantity of liquid initially flows into said chamber through said first opening for imparting movement to said float seal for subsequently sealing said first opening, thereafter compressed air supplied to said chamber displaces said liquid through said discharge opening thereby releasing said seal for repeating a pumping operation by again permitting another predetermined quantity of liquid to flow into said chamber through said first opening.

2. A pneumatically operated submersible pump according to claim 1, wherein said lower surface is removably mounted relative to said sidewalls.

* * * * *